United States Patent [19]

Alford

[11] Patent Number: 4,558,866

[45] Date of Patent: Dec. 17, 1985

[54] REGULAR POLYHEDRON-BASED LOGICAL PUZZLES

[76] Inventor: William L. Alford, 5775 Pindell Rd., Lothian, Md. 20820

[21] Appl. No.: 293,321

[22] Filed: Aug. 14, 1981

[51] Int. Cl.[4] ..... A63F 9/08

[52] U.S. Cl. ..... 273/153 S

[58] Field of Search ..... 273/153 S, 155

[56] References Cited

U.S. PATENT DOCUMENTS

| | | | |
|---|---|---|---|
| 2,245,875 | 6/1941 | Rutherford | 273/155 |
| 2,839,841 | 6/1958 | Berry | 273/157 R X |
| 2,923,551 | 2/1960 | Pope | 273/157 R |
| 2,939,243 | 6/1960 | Duggar | 273/157 R X |
| 3,222,072 | 12/1965 | Dreyer | 273/155 |
| 3,565,442 | 2/1971 | Klein | 273/157 R |
| 3,655,201 | 4/1972 | Nichols | 273/153 R |
| 3,659,360 | 5/1972 | Zeischegg | 273/157 R X |
| 3,690,672 | 9/1972 | Dreyer | 273/155 |
| 3,747,261 | 7/1973 | Sale | 273/155 X |
| 3,773,329 | 11/1973 | Sector | 273/153 R |
| 4,063,725 | 12/1977 | Snyder | 46/1 L X |
| 4,121,831 | 10/1978 | Greene | 273/160 |
| 4,177,993 | 12/1979 | Crosby et al. | 273/160 |

FOREIGN PATENT DOCUMENTS

| | | | |
|---|---|---|---|
| 42695 | 12/1981 | European Pat. Off. | 273/153 S |
| 8104382 | 7/1981 | Fed. Rep. of Germany | 273/153 S |
| 170062 | 12/1977 | Hungary | 273/153 S |
| 55-3956 | 1/1980 | Japan | 273/153 S |
| 55-8192 | 3/1980 | Japan | 273/153 S |
| 55-8193 | 3/1980 | Japan | 273/153 S |
| 283666 | 1/1928 | United Kingdom | 273/157 R |
| 675678 | 7/1952 | United Kingdom | 273/157 R |
| 2084471 | 4/1982 | United Kingdom | 273/153 S |

*Primary Examiner*—Anton O. Oechsle

*Attorney, Agent, or Firm*—Lowe, King, Price & Becker

[57] ABSTRACT

A three dimensional regular polyhedron based logical puzzle having a plurality of exposed faces with design indicia printed thereon includes a plurality of first and second pieces defined by at least four non-orthogonal planes extending through the puzzle. Each of the planes is parallel to at least a different one of the faces and extends through the geometric center of the puzzle to form the first pieces contiguous with an associated group of second pieces to define a cluster formed outwardly from a corresponding bisecting plane. The cluster is capable of rotational movement about non-orthogonal axes extending through the first pieces. Rotation of the clusters causes the second pieces to interchange positions with each other to locate exposed surfaces of the pieces on different faces of the polyhedron to achieve a desired design pattern solution thereon. Guide elements, tongue and groove locking mechanisms or magnet means are provided to retain the pieces together in interfitting relationship and allow for smooth sliding rotation of the clusters to interchange positions of the second pieces.

15 Claims, 14 Drawing Figures

REGULAR POLYHEDRON-BASED LOGICAL PUZZLES

TECHNICAL FIELD

This invention relates generally to three dimensional logical puzzles, and more particularly to polyhedron shaped puzzles comprising pieces rotatable in clusters to form indicia solution patterns printed on exposed faces of the polyhedron.

BACKGROUND ART

Logical puzzles are known to challenge intellect and aid in the development of logical thinking. Two or three dimensional logical puzzles typically include a plurality of pieces which require interfitting to form predetermined shapes or patterns, the patterns being based upon elemental geometric or design indicia printed on exposed surfaces of the interfitting pieces. Such puzzles can be fun and challenging; however, the separate pieces are easily lost tending to destroy the functional unit of the puzzle.

To overcome the shortcomings of the aforementioned puzzles and provide further challenge, three dimensional logical puzzles have been devised which include separate, smaller pieces interlocked to form a large cube or like body, as typified by the devices disclosed in Hungarian Pat. No. 170,062 to Rubik or U.S. Pat. No. 3,655,201 to Nichols. In these devices, cutting planes divide the body into a $2\times2$ or $3\times3$ network of identical pieces forming the body; the pieces formed by the planes rotate in groups about axes perpendicular to each other to allow for rearrangement of the exposed surfaces of each piece to achieve a desired pattern formed on outer faces of the large cube or like body. The pieces are retained to form an indissoluble cube with magnet means, or flexible pins projecting outwardly from an interior central piece for interconnection to the pieces.

Generally, such three dimensional logical puzzles are both challenging and entertaining to the user. However, due to the symmetries achieved with orthogonal cutting planes dividing the large body into like, smaller pieces, a unique problem not readily ascertainable surfaces; namely, prolonged use of these devices enables the user to memorize the travel paths of the pieces and thereby develop strategies to achieve the desired solution. Thus, while habits of memory retention, concentration and logical thinking are promoted with such devices, the aforesaid plane symmetries required therein tend to limit their educational value.

It is accordingly an object of the present invention to provide a three dimensional logical puzzle wherein smaller pieces form polyhedra-based puzzles requiring concentration and logical thinking to move the smaller pieces to form predetermined shapes or patterns on the outer faces of the puzzle.

Another object is to provide a three dimensional puzzle wherein non-orthogonal cutting planes divide the polyhedra into differently sized smaller pieces which interfit and rotate in clusters about non-orthogonal axes of rotation.

Still another object is to provide a three dimensional puzzle wherein certain puzzle pieces are capable of rotation between intersecting planes to define travel paths within a spatially asymmetrical environment.

Yet a further object is to provide a three dimensional logical puzzle wherein the interlocking pieces form a regular tetrahedron.

A still further object is to provide a puzzle wherein the interlocking pieces form a regular octahedron.

Yet another object is to provide a puzzle wherein the interlocking pieces form a dodecahedron.

DISCLOSURE OF THE INVENTION

A polyhedron based logical puzzle, according to the present invention, comprises a plurality of first and second solid pieces defined by at least four non-orthogonal planes extending through the puzzle to bisect the polyhedron. Each plane is parallel to at least a different one of the polyhedron faces. Non-orthogonal axes of rotation extend through the first pieces perpendicular to the bisecting planes to allow for rotation of a different first piece and contiguous second pieces formed outwardly from a corresponding plane. Each cluster rotating about corresponding axes causes the second pieces to interchange positions with each other. Exposed surfaces of the first and second pieces having indicia printed thereon are thereby rotated and interchanged to achieve a predetermined solution pattern on the polyhedron faces. Means is provided for interconnecting the first pieces for rotation about the non-orthogonal axes and for interfitting the second pieces together with the first pieces for interchanging movement.

In a preferred embodiment, a tetrahedron based puzzle requires four planes to bisect the puzzle into four identical first pieces and six identical second pieces contiguous with the first pieces. A center piece located within the puzzle interior includes four pins each coaxially aligned with one of the non-orthogonal axes. The pins receive a screw passing through each of the first pieces for interconnecting rotational movement. Arcuately formed guide members located on the second pieces engage inwardly directed concave surfaces formed on the first pieces for interfitting, sliding engagement therewith.

In other embodiments, octahedron and dodecahedron shaped logical puzzles are disclosed; first and second pieces provided in these puzzles are defined by bisecting planes extending through the geometric center of the puzzle parallel respectively to a different pair of corresponding, opposed polyhedron faces. Guide elements, tongue and groove locking mechanisms, and magnet means enable the first and second pieces to interfit with contiguous pieces in sliding engagement therewith to form the puzzles.

Still other objects and advantages of the present invention will become readily apparent to those skilled in this art from the following detailed description, wherein I have shown and described only the preferred embodiments of the invention, simply by way of illustration of the best mode contemplated by me of carrying out my invention. As will be realized, the invention is capable of modifications in various obvious respects, all without departing from the invention. Accordingly, the drawings and description are to be regarded as illustrative in nature, and not as restrictive.

BEST MODE FOR CARRYING OUT THE INVENTION

Figure 1:
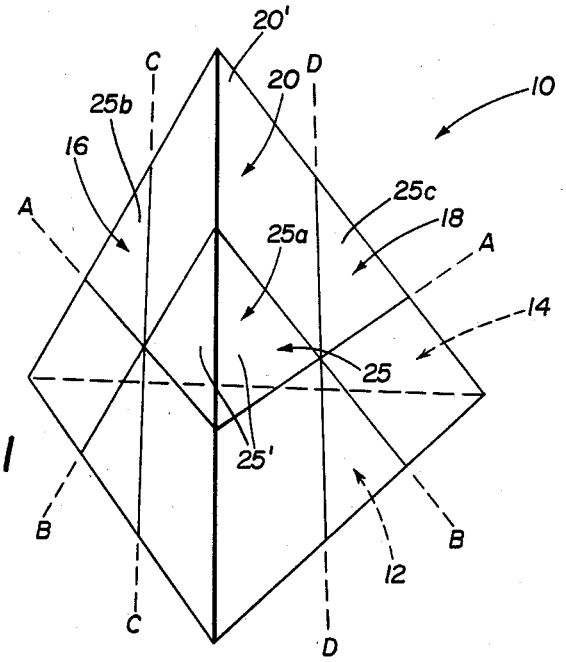
FIG. 1 is a perspective view of an assembled, tetrahedron based logical puzzle according to the present invention.
Figure 2:
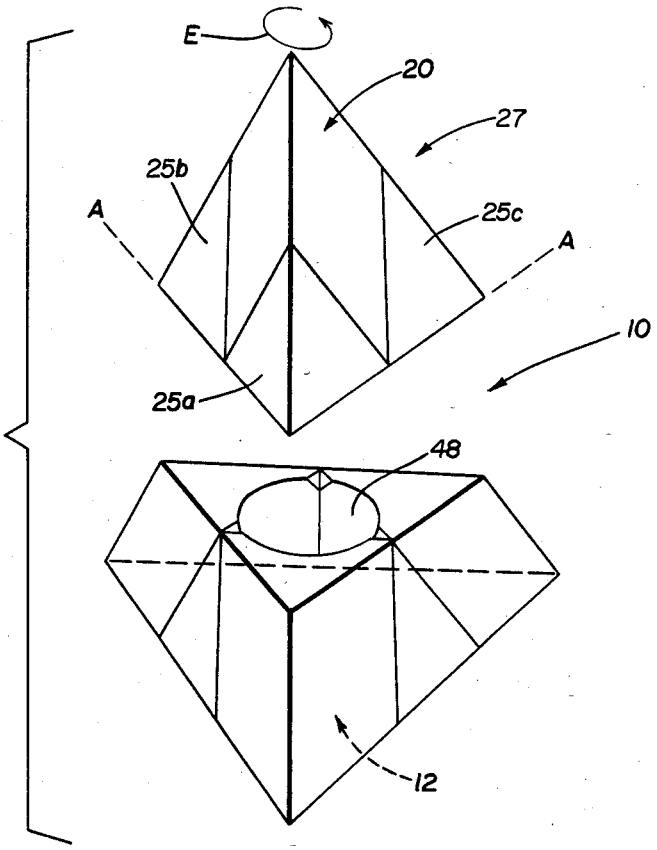
FIG. 2 is another perspective view similar to FIG. 1 showing the puzzle in partially disassembled form, wherein a cluster of first and second pieces is detached from the remainder of the puzzle.

Reference is now made to FIGS. 1 and 2, wherein a logical puzzle 10 of the invention, in accordance with a preferred embodiment, is a tetrahedron shaped solid, including faces 12, 14, 16 and 18 that respectively form equilateral triangles.

Puzzle 10 comprises separate first and second pieces 20, 25, respectively, defined by four planes A—A, B—B, C—C and D—D extending through the tetrahedron one third the distance from one of faces 12–18 respectively, measured between each base and a corresponding apex. Each plane thereby bisects the tetrahedron into one of clusters 27, formed outwardly from the plane (see FIG. 2), by extending parallel to a different one of faces 12–18 through puzzle 10, as discussed, supra. For example, as best shown in FIGS. 1 and 2, plane A—A extends through the tetrahedron parallel to face 12 (hidden from view in FIG. 1), to divide the solid and define one of clusters 27. Planes B—B through D—D divide the representative clusters 27 into one first piece 20 contiguous with three second pieces 25*a–c*.

Bisecting planes A—A through D—D together divide the tetrahedron into four clusters 27, each having one of the identical first pieces 20. Each first piece 20 is a seven sided member located at the apex of the tetrahedron; six of the second pieces 25 are also formed by the planes into tetrahedron shapes. A seventh tetrahedron that would otherwise exist in the center of puzzle 10 (not shown) is removed to position a locking means 30 (see FIG. 3) in the center, as discussed more fully below.

Thus, each of the first and second pieces 20, 25 respectively provides three and two outwardly exposed surfaces 20', 25' (see FIG. 1). Each of the surfaces 20', 25' has printed thereon design or color indicia. When first and second pieces 20, 25 are properly rotated by the user, as discussed infra, exposed surfaces 20', 25' are capable of forming a predetermined solution pattern on the polyhedron faces.

Each of clusters 27 is capable of rotation about an axis L passing through the apex of a first piece. 20 and normal to the inwardly facing base side thereof. Second pieces 25 are contiguous with separate first pieces 20, as discussed above, so as to interchange positions with other adjacent second pieces during rotation of adjacent clusters 27 along one of corresponding planes A—A through D—D about a corresponding axis L. As shown in FIG. 2, rotation by 120° or 240° of one first piece 20 and three contiguous second pieces 25*a–c* (see arrow E in FIG. 2), followed by rotation of other clusters about their respective axes, advantageously causes the second pieces to exchange positions with each other.

To achieve proper rotation of the different clusters 27 about axes extending respectively through each of first pieces 20, the axes intersect with each other at the geometric center of the tetrahedron to advantageously form angles of approximately 109° (i.e. 90° +arccot ($2\sqrt{2}$) with each of the other three axes. The advantages derived through use of the aforementioned non-orthogonal axes and planes are discussed more fully below.

Figure 3:
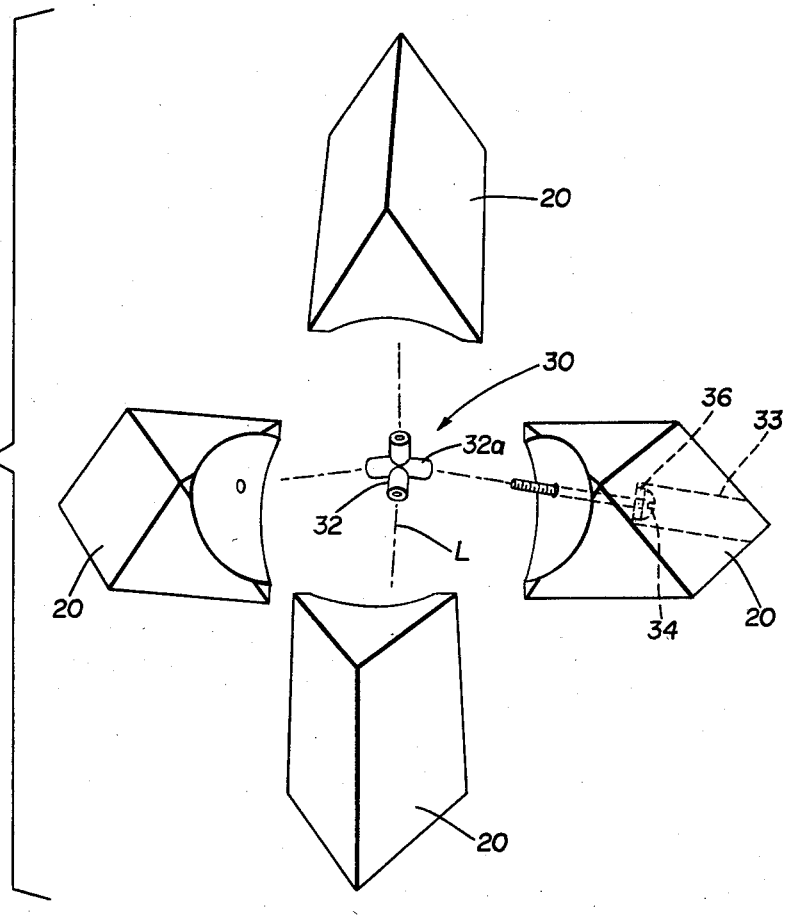
FIG. 3 is an exploded, perspective view of the first pieces of the tetrahedron based puzzle showing locking means interconnecting the first pieces together for rotational movement about non-orthogonal axes.

Rotation of the various clusters 27 about their respective axes along associated cutting planes A—A-D—D is advantageously achieved with locking means 30. As shown in FIG. 3 only, locking means 30 preferably includes a center piece 32 located in the interior, geometric center of the tetrahedron puzzle. Center piece 32 includes four projections 32*a* respectively aligned with the non-orthogonal axes L passing through each first piece 20. A recessed bore 33 extending through each first piece 20 enables insertion of a screw 34 from outside the puzzle through the bore to fasten the first pieces to the center piece. Alignment of each screw with the axes extending through different first pieces 20, as aforesaid, advantageously allows the first pieces to rotate about their respective axes. A spring 36 located between the screw head and the bottom of the recessed bore formed in each first piece advantageously reduces friction generated between adjoining surfaces of contiguous first and second pieces for smooth rotation of the pieces along one of planes A—A through D—D.

Figure 4:
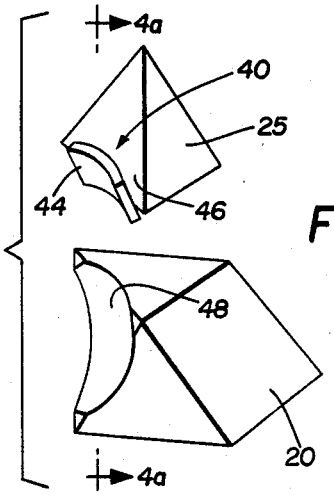
FIG. 4 is a partial perspective view of a first and second piece of the tetrahedron shaped puzzle showing locking means enabling interfitting engagement between the first piece and contiguous second piece.
Figure 4A:
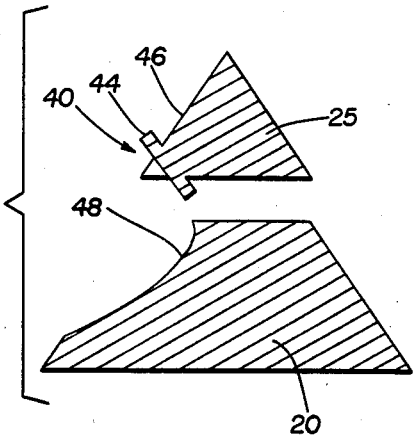
FIG. 4*a* is a view taken through the line 4*a*—4*a* of FIG. 4 illustrating locking engagement of the first and second pieces.

To allow for secure interfitting of second pieces 25 contiguous with first pieces 20 and smooth sliding movement therebetween during rotation of clusters 27, locking means 40 is provided. As shown in FIG. 4, such locking means 40 preferably includes an elongated guide member 44 secured along an inwardly directed edge 46 of each second piece 25. Each guide member 44 projects slightly towards the geometric center of puzzle 10 but does not contact center piece 32 or screws 34 located on the non-orthogonal axes. As shown in FIG. 4, each guide member 44 includes arcuate protrusions projecting outwardly from the inwardly directed edge of each second piece; such protrusions are captured between adjacent interior concave surfaces 48 of first pieces 20 for smooth sliding rotational movement to interchange positions with other second pieces. Concave surfaces 48 together define a hollow sphere surrounding center piece 32 to achieve aforesaid rotational movement thereabout.

Tetrahedron puzzle 10, divided into separate first and second pieces 20, 25 with bisecting planes A—A through D—D for rotation about the aforesaid non-orthogonal axes provided therewithin, advantageously provides several unexpected advantages. For example, rotational movement of exposed surfaces 25' of second pieces 25 which allows such pieces to interchange positions with each other between clusters is asymmetric in relation to the relative orientation of exposed surfaces 20' provided on first pieces 20. Other asymmetries are achieved since exposed surfaces 25' can be rotated either 120° or 240° prior to rotation along a different one of non-orthogonal planes A—A through D—D. Since the dihedral angles between respective clusters are also non-orthogonal, greater concentration is required by the user to memorize the travel paths of the pieces and develop strategies to achieve the desired solution pattern. Additionally, the non-orthogonal, geometric shapes achieved with the present invention are also entertaining to the user.

Figure 5:
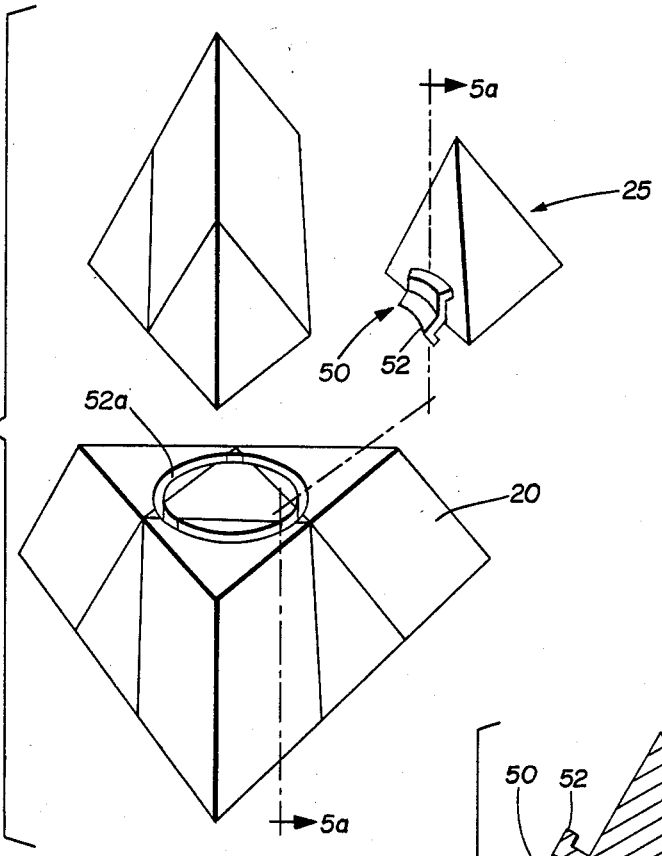
FIG. 5 is a perspective view of the tetrahedron puzzle showing tongue and groove locking means for interfitting the pieces.
Figure 5A:
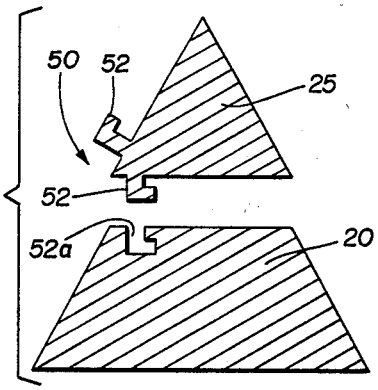
FIG. 5*a* is a view taken through the line 5*a*—5*a* in FIG. 5.

Other locking means are possible to allow for interfitting, rotational movement between first and second pieces 20, 25, as aforesaid. For example, as shown in FIGS. 5 and 5*a*, locking means 50 includes a tongue and groove mechanism 52, 52*a* formed respectively along an inwardly directed edge of second pieces 25 and first pieces 20. Tongue 52 is capable of interlocking engagement within the corresponding, arcuate L-shaped groove 52*a* formed along three interior surfaces of first pieces 20 located coplanar with three of the bisecting planes. To assemble first and second pieces 20, 25 forming puzzle 10 with locking means 50, first pieces 20 can be fabricated in two separate parts divided along the groove (not shown in detail) and thereby fastened together as the last piece is assembled.

Alternatively, a metal sphere located in the geometric center of puzzle 10 can be provided to retain each of the first and second pieces in interfitting position, due to magnetic attraction between the ball and magnets embedded in each of the pieces (not shown).

Figure 6:
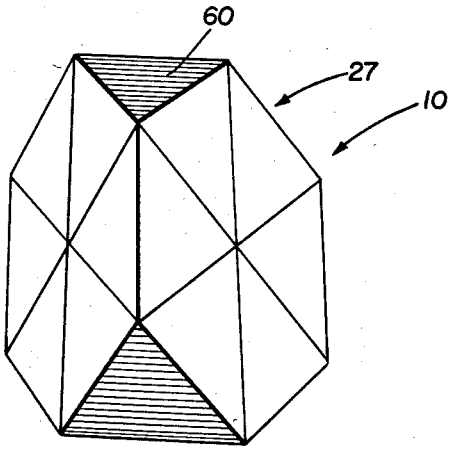
FIG. 6 is a perspective view of a tetrahedron based logical puzzle showing the apices cut off to form a different puzzle shape.
Figure 7:
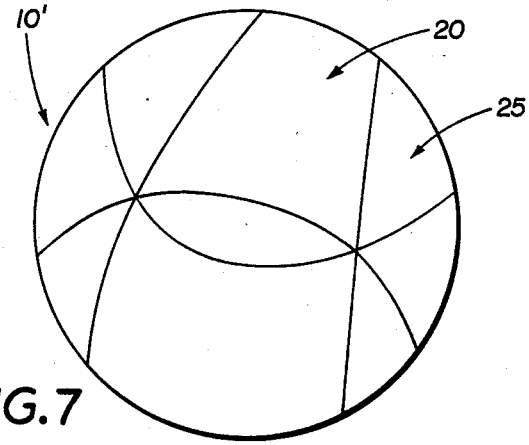
FIG. 7 is another perspective view of a tetrahedron based puzzle showing the outer surfaces thereof contoured to form a spherical puzzle.
Figure 8:
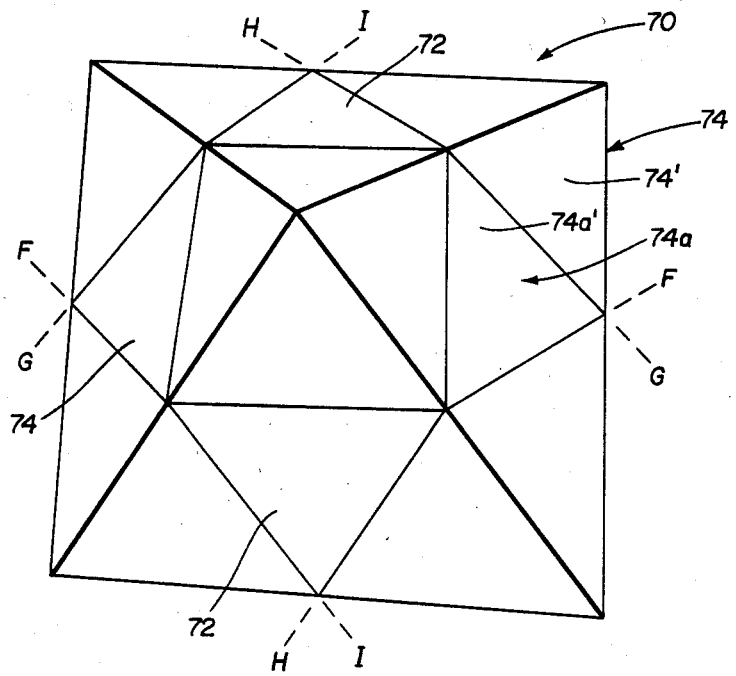
FIG. 8 is a perspective view of an octahedron shaped puzzle according to the present invention showing location of the bisecting planes to form first and second pieces.
Figure 9:
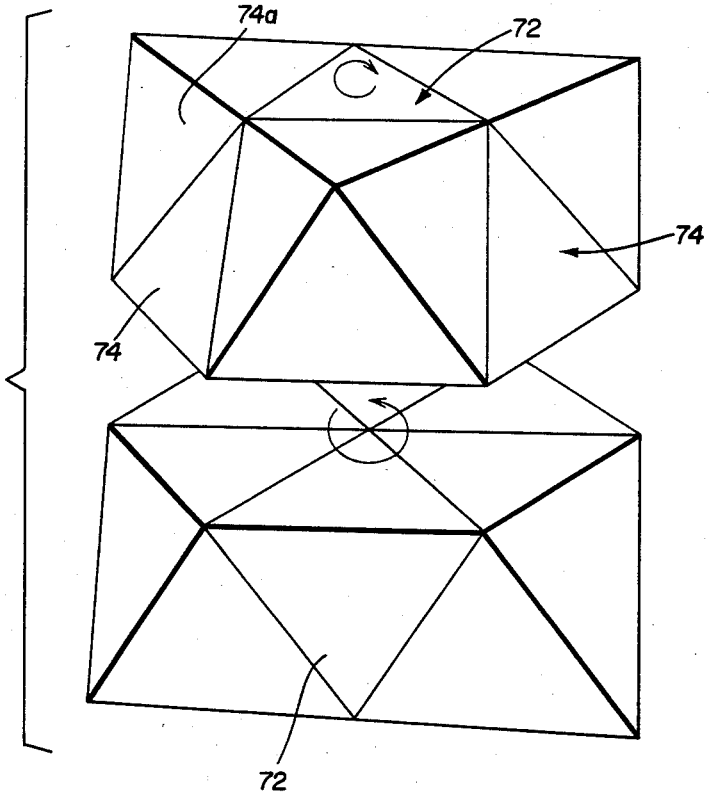
FIG. 9 is a perspective view of the puzzle shown in FIG. 8 illustrating a cluster of first and second pieces detached from the remainder of the puzzle for rotation along corresponding bisecting plane.

Because of the aforesaid geometries in tetrahedron shaped puzzle 10 provided by bisecting planes A—A through D—D, almost any arbitrary exterior shape is possible without drilling additional holes or requiring extra pieces if the surface of that shape intersects the center of each face 12–18 where three of bisecting planes A—A through D—D meet. For example, as shown in FIG. 6, the apices of tetrahedron shaped puzzle 10 can be cut off, thereby varying the shape of the tetrahedron and also provide for comfortable gripping surfaces 60 to rotate clusters 27. A spherical puzzle 10' can also be fabricated (see FIG. 7).

Referring now to FIGS. 8–11 of the drawing, a second preferred embodiment of the invention is shown in the form of octahedron shaped puzzle 70. Puzzle 70 comprises eight of tetrahedron shaped and six of octahedron shaped pieces defined by four of planes F—F, G—G, H—H, and I—I. Each of planes F—F through I—I extends through the geometric center of the octahedron in parallel relation to a different pair of outer faces of the puzzle.

Four of the tetrahedron shaped pieces define first pieces 72 which are respectively located on four rotational axes L (see FIG. 10) extending through the first pieces, as discussed in connection with tetrahedron shaped puzzle 10. Each of first pieces 72 is contiguous with three of octahedron shaped second pieces 74 and three of tetrahedron shaped second pieces 74*a* to define a cluster of pieces located outwardly adjacent each of the bisecting planes, as in the case of tetrahedron shaped puzzle 10.

The four rotational axes L respectively extending through each of first pieces 72 are normal to bisecting planes F—F through I—I. Rotation of an aforesaid cluster of pieces is achieved by gripping of second pieces 74, 74*a* located within the cluster and rotating the same about one of the axes extending through an associated first piece 72; the first pieces allow for pivotal, rotational movement of contiguous pieces 74, 74*a* during rotation about their own axes. By rotating second pieces 74, 74*a* 120° or 240°, exposed surfaces 74', 74*a'* thereon are correspondingly rotated to form a part of adjacent faces of the octahedron puzzle (see FIG. 9).

Figure 10:
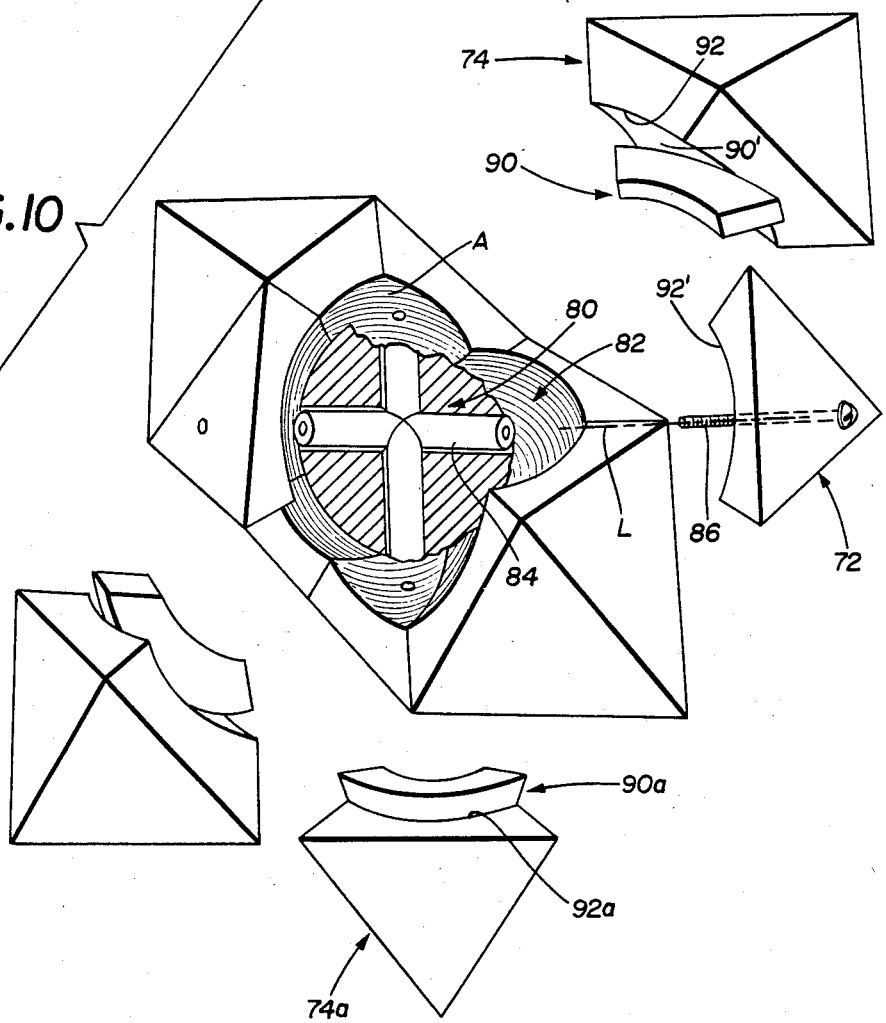
FIG. 10 is an exploded, partial perspective view of the octahedron shaped puzzle showing locking means therefor.

Locking means 80 is provided within puzzle 70 to assure proper interfitting and rotational movement of first and second pieces 72, 74, 74*a*. As shown in FIG. 10 only, such locking means 80 preferably includes a sphere 82 (partially broken away) positioned within a spherical hollow area A located in the geometric center of puzzle 70 and defined by inwardly directed concave surfaces of the first and second pieces. The diameter of sphere 82 is slightly less than the corresponding diameter of spherical area A and includes four of pins 84 projecting outwardly from the sphere in coaxial alignment with rotational axes L of first pieces 72. Screws 86 rotatably secures first pieces 72 to pins 84 to allow for rotational movement of the first pieces, as aforesaid.

Guide elements 90 and 90*a* provided along interior facing surfaces 92, 92*a* of second pieces 74 and 74*a* respectively, allow interfitting and rotational movement with contiguous first and second pieces. Interior surfaces 92, 92*a* and interior surface 92' of first pieces 72 define the boundaries of interior spherical area A of puzzle 70, as aforesaid, and are uniformly spaced away from the outer surface of sphere 82.

Guide elements 90, located along interior surface 92 of octahedron shaped second pieces 74, include protrusions projecting outwardly from two opposite unexposed sides of the second piece, thereby defining two concave surfaces 90' formed on opposite sides of the guide elements. Guide elements 90 are crescent shaped and dimensional to contact and slide on the outer surface of sphere 82 during rotation of second pieces 74. Guide elements 90*a*, covering interior surface 92*a* of tetrahedron shaped second pieces 74*a*, are arcuately formed to project outwardly beyond the hidden surfaces of the second pieces 74*a*. Guide elements 90, 90*a* include concave inwardly directed surfaces which slide on the outer surface of sphere 82 during rotation of pieces 74 and 74*a*.

In interfitting position with second pieces 74 and 74*a*, the projections of guide elements 90, 90*a* engage surfaces 90' and 92' in interlocking position, and also contact the outer surface of sphere 82 in sliding engagement therewith. During rotation of the clusters with locking means 80 provided by the present invention, the projections of guide elements 90 and 90*a* properly interfit within corresponding surfaces 90' and 92' without conflicting with the protrusions of guide elements 90 for smooth sliding rotation of the clusters along sphere 82.

Figure 11:
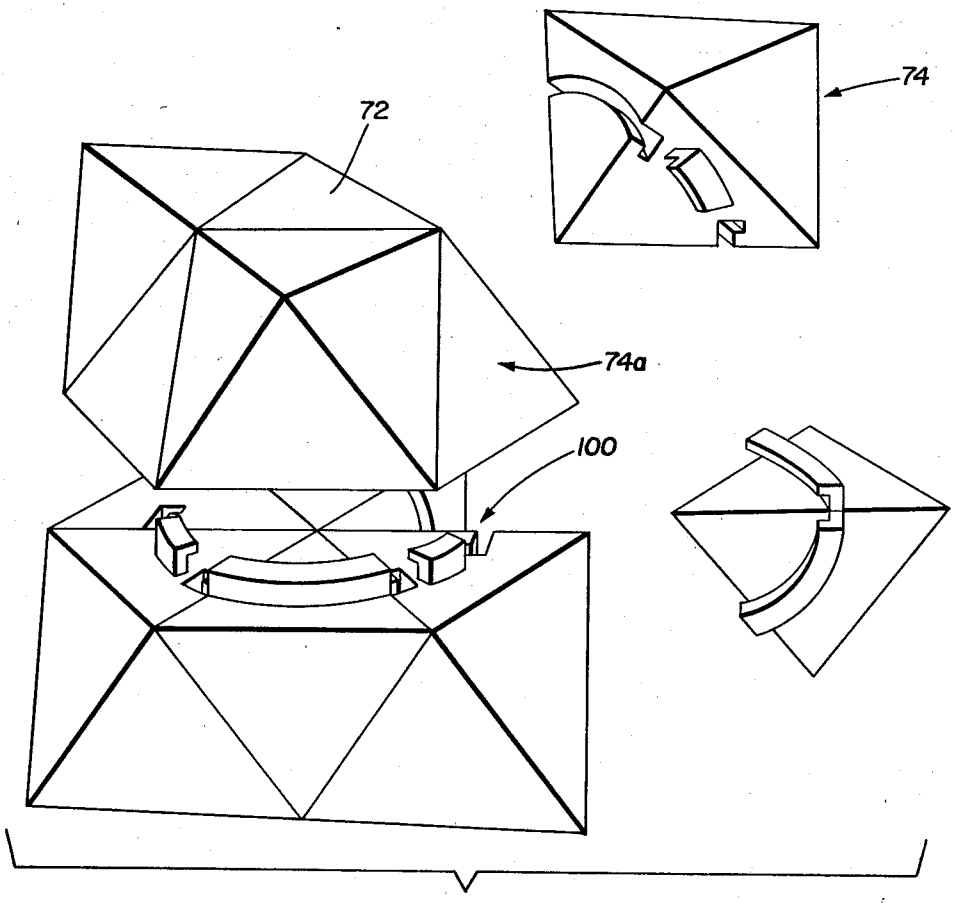
FIG. 11 is an exploded, perspective view of the octahedron shaped puzzle showing the use of tongue and groove locking means for interfitting the pieces.

FIG. 11 shows the use of a tongue and groove locking mechanism 100 which is similar in operation to the tongue and groove mechanism shown in FIG. 5, as aforesaid. Tongue and groove locking mechanism 100 advantageously interfits first and second pieces 72, 74, 74*a* without requiring the use of pins engaging the first pieces along the rotational axes extending therethrough.

With the design of octahedron puzzle 70, the external shape is arbitrary. The surface thereof does not have to pass through any particular points or planes as required in tetrahedron puzzle 10.

Figure 12:
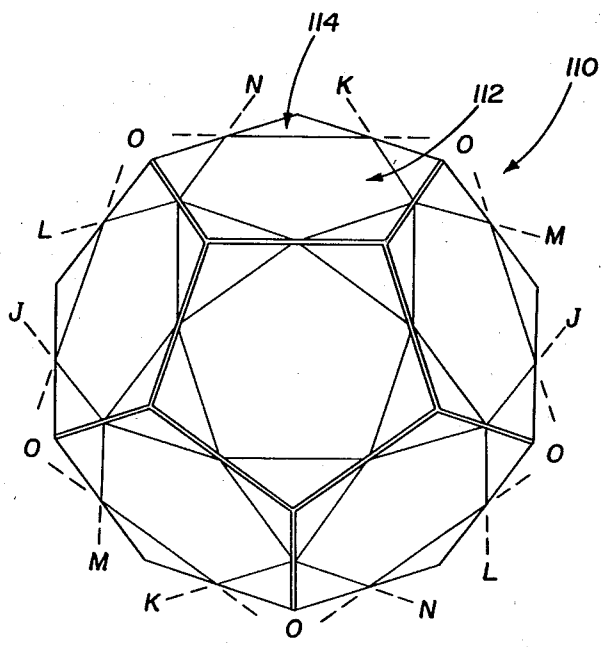
FIG. 12 is a perspective view of an assembled dodecahedron shaped puzzle according to the invention showing location of six planes bisecting the puzzle into first and second pieces.

FIG. 12 shows a third embodiment of the invention wherein dodecahedron 110 is shown in perspective view. Dodecahedron 110 is a twelve side regular polyhedron, wherein each of the twelve faces is pentagon shaped. Dodecahedron 110 is divided into first and second pieces 112, 114 by six of planes J—J through O—O. Planes J—J through O—O respectively extend through the geometric center of the dodecahedron parallel to a different pair of puzzle faces to define twelve of first pieces 112 and twenty of second pieces 114.

As shown in FIG. 12, first pieces 112 include one exposed surface forming part of the dodecahedron faces and are pentagon shaped; second pieces 114 define pieces of the dodecahedron and are located contiguous with respective first pieces 112. Magnet means, such as a center metal ball magnetically attracting magnets located within each of first and second pieces 112, 114 retains the pieces in interfitting relationship for rotational movement parallel to the bisecting planes.

In this disclosure, there are shown and described only the preferred embodiments of the invention, but, as aforementioned, it is to be understood that the invention is capable of use in other various combinations and environments and is capable of changes or modifications within the scope of the inventive concept as expressed herein. For example, in each of the aforesaid embodiments, sets of parallel planes (not shown), with each set being non-orthogonal with the other sets, can be used to cut the puzzle into additional pieces, to thereby achieve more complex solution patterns.

I claim:

1. A three dimensional polyhedron-based logical puzzle having a plurality of exposed faces, comprising:

(a) a plurality of first and second pieces defined by at least four non-orthogonal planes, each of said planes being parallel respectively to a different one of said faces and bisecting the puzzle, each of said first pieces being formed contiguous with an associated group of second pieces to define a cluster formed outwardly from a corresponding one of said planes, said cluster capable of rotational movement about non-orthogonal axes extending respectively through each of said first pieces, whereby rotation of said clusters causes said second pieces to interchange positions with each other;

(b) first means interconnecting said first pieces together, said first means extending through said non-orthogonal axes to enable the first pieces to be rotated about their respective axes; and (c) second means for interlocking said contiguous first and second pieces to each other to form the polyhedron and enabling the positions of the second pieces to be interchanged.

2. A logical puzzle according to claim 1, wherein each of said first and second pieces includes at least one exposed surface respectively located on faces of the polyhedron, said exposed surfaces having indicia printed thereon, whereby rotation of said first and second pieces for interchanging positions of the second pieces enables the user to form a predetermined solution pattern on the polyhedron faces.

3. A logical puzzle according to claim 2, wherein said polyhedron is tetrahedron-shaped defined by four planes bisecting the tetrahedron into said first and second pieces, each of said planes extending parallel to a different one of said faces through the tetrahedron.

4. A logical puzzle according to claim 3, wherein said planes form boundaries of four identical first pieces having seven sides forming the apices of the tetrahedron, and six identical second pieces, said second pieces being tetrahedron-shaped.

5. A logical puzzle according to claim 4, wherein said non-orthogonal axes form an angle of approximately $90° + \text{arccot}(2\sqrt{2})$ with each other.

6. A logical puzzle according to claim 5, wherein said first means includes a center piece located at the geometric center of the tetrahedron, and four projections each extending along a different one of said axes to rotatably interconnect said first pieces with the center piece.

7. A logical puzzle according to claim 6, wherein said second means includes a plurality of guide members each secured to an inwardly directed portion of a different second piece and interlocking said second pieces to adjacent first pieces, said guide members being formed to slidably engage an endless concave surface formed on inwardly directed portions of the first pieces, thereby enabling rotational movement and interchanging positions of the second pieces.

8. A logical puzzle according to claim 2, wherein said polyhedron is octahedron shaped and includes four planes bisecting the octahedron into said first and second pieces, each of said planes extending parallel to a corresponding diametrically opposed pair of said faces through the geometric center of the octahedron.

9. A logical puzzle according to claim 8, wherein said planes define four identical four-sided first pieces, four identical four-sided second pieces and six identical eight-sided second pieces.

10. A logical puzzle according to claim 2, wherein said polyhedron is dodecahedron shaped and includes six planes bisecting the dodecahedron into said first and second pieces, each of said planes extending parallel to a corresponding diametrically opposed pair of said faces through the geometric center of the dodecahedron.

11. A logical puzzle according to claim 8, wherein said first means includes a substantially spherical shaped center piece located at the geometric center of the octahedron, and four projections each extending along a different one of said axes to rotatably interconnect said first pieces with the spherical piece, and said second means includes a plurality of guide elements each secured to an inwardly directed portion of a different second piece for interlocking said first and second pieces together, said guide members being formed to slidably engage an endless concave surface formed on inwardly directed portions of the first pieces and inwardly directed portions of said eight sided second pieces, thereby enabling rotational movement and interchanging positions of the second pieces.

12. A polyhedral puzzle comprising: an assemblage of elements each provided with at least one outwardly exposed indicia-bearing planar face; means maintaining said elements together in a solved configuration of said assemblage defining a polyhedron with each face of said polyhedron constituted by a plurality of said element faces having a prescribed indicia array, and means permitting groups of said elements to be rotated about at least four non-orthogonal axes of said polyhedron such that said faces of said rotated elements constitute portions of other ones of said polyhedron faces, said rotations resulting in the interchanging of said elements among said groups thereof and disordered arrays of indicia on the faces of said polyhedron.

13. A tetrahedron-shaped puzzle comprising a plurality of puzzle pieces, each such piece having at least one externally visible surface with visually distinct indicia thereon, each such piece having means for maintaining that piece in assembled movable relation with respect to other such pieces for shuffling of said puzzle and including pieces located at each corner of said puzzle, respectively.

14. A shiftable element puzzle comprising: a plurality of elements each provided with at least one equilateral triangular face, means maintaining said elements in a regular octahedron configuration with each face of said octahedron being constituted by a plurality of said triangular faces, and means permitting groups of said elements to be rotated about axes perpendicular to the faces of said octahedron such that said octahedron faces are selectively constituted by differing combinations of said triangular faces.

15. A tetrahedron-shaped puzzle comprising a plurality of puzzle pieces, each such piece having at least one externally visible surface with visual distinct indicia thereon, each such piece having means for maintaining that piece in assembled movable relation with respect to other such pieces for shuffling of said puzzle.

* * * * *